US009395156B2

(12) United States Patent
Newzella et al.

(10) Patent No.: US 9,395,156 B2
(45) Date of Patent: Jul. 19, 2016

(54) FIRE CONTROL SIGHT, HAND-HELD FIREARM AND A METHOD FOR ORIENTING A HAND-HELD FIREARM

(71) Applicant: MBDA Deutschland GmbH, Schrobenhausen (DE)

(72) Inventors: Alfons Newzella, Alling (DE); Michael Weidacher, Unterschleissheim (DE)

(73) Assignee: MBDA Deutschland GmbH, Schrobenhausen (DE)

( * ) Notice: Subject to any disclaimer, the term of this patent is extended or adjusted under 35 U.S.C. 154(b) by 0 days.

(21) Appl. No.: 14/555,815

(22) Filed: Nov. 28, 2014

(65) Prior Publication Data

US 2015/0153137 A1 Jun. 4, 2015

(30) Foreign Application Priority Data

Nov. 29, 2013 (DE) ..... 10 2013 017 997
Jan. 24, 2014 (DE) ..... 10 2014 001 028

(51) Int. Cl.

| | |
|---|---|
| ***G06G 7/80*** | (2006.01) |
| ***F41G 1/01*** | (2006.01) |
| ***F41G 1/34*** | (2006.01) |
| ***F41G 1/473*** | (2006.01) |
| ***F41G 1/48*** | (2006.01) |
| ***F41G 3/06*** | (2006.01) |

(52) U.S. Cl.
CPC *F41G 1/01* (2013.01); *F41G 1/345* (2013.01); *F41G 1/473* (2013.01); *F41G 1/48* (2013.01); *F41G 3/06* (2013.01)

(58) Field of Classification Search
CPC ..... F41G 3/06; F41G 3/08; F41G 1/473
USPC ..... 235/400–418
See application file for complete search history.

(56) References Cited

U.S. PATENT DOCUMENTS

| | | | | |
|---|---|---|---|---|
| 6,499,382 | B1 | 12/2002 | Lougheed et al. | |
| 2005/0198885 | A1 | 9/2005 | Staley, III | |
| 2005/0268521 | A1 | 12/2005 | Cox et al. | |
| 2007/0056203 | A1 | 3/2007 | Gering et al. | |
| 2009/0266892 | A1* | 10/2009 | Windauer | F41G 1/38 235/404 |
| 2010/0282843 | A1* | 11/2010 | Staley, III | F41G 1/52 235/404 |
| 2013/0133213 | A1 | 5/2013 | Gorsuch et al. | |

FOREIGN PATENT DOCUMENTS

| | | |
|---|---|---|
| EP | 0 785 406 A2 | 7/1997 |

* cited by examiner

*Primary Examiner* — Jamara Franklin
(74) *Attorney, Agent, or Firm* — Crowell & Moring LLP

(57) ABSTRACT

A fire control sight for a hand-held firearm includes a sight housing, a front sight, and a sight guide having two sight guide side pieces with a plurality of sight crosspieces forming rear sights. The fire control sight also includes a range finder, at least one inertial sensor and/or a magnetic field sensor, a control computer, and a display device for displaying an optimal orientation of the barrel axis of the hand-held firearm determined by the control computer.

15 Claims, 9 Drawing Sheets

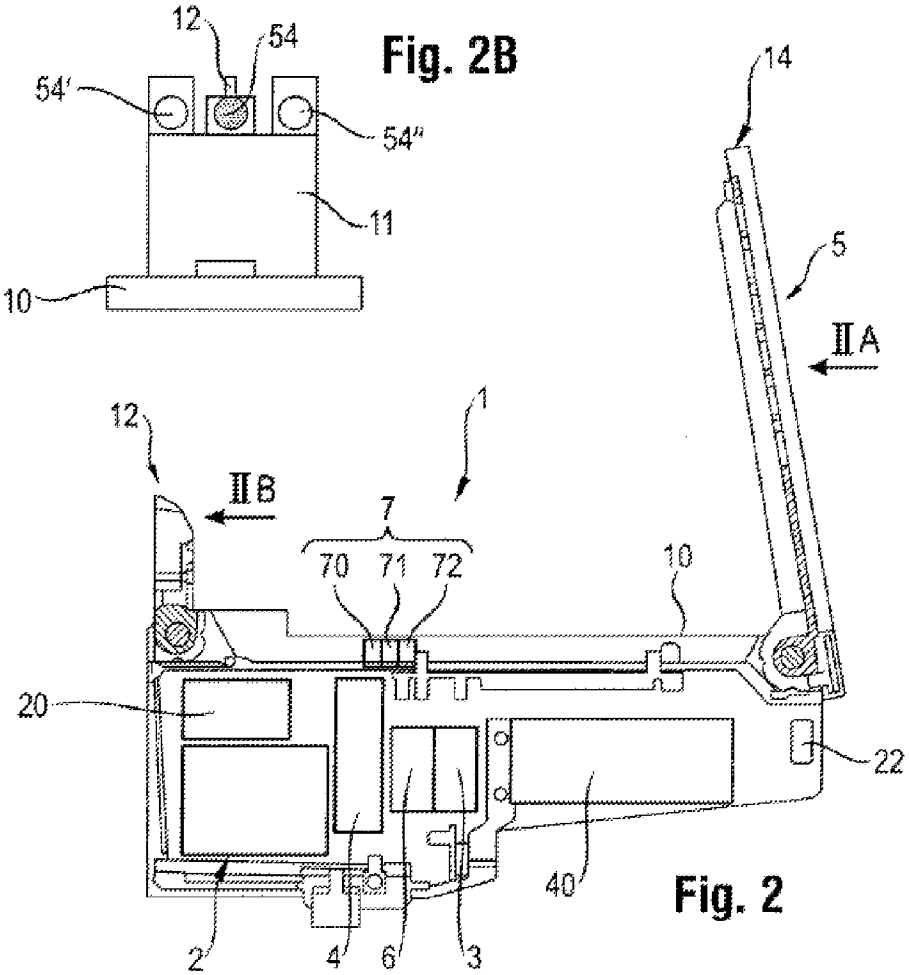
Fig. 2
Fig. 2B
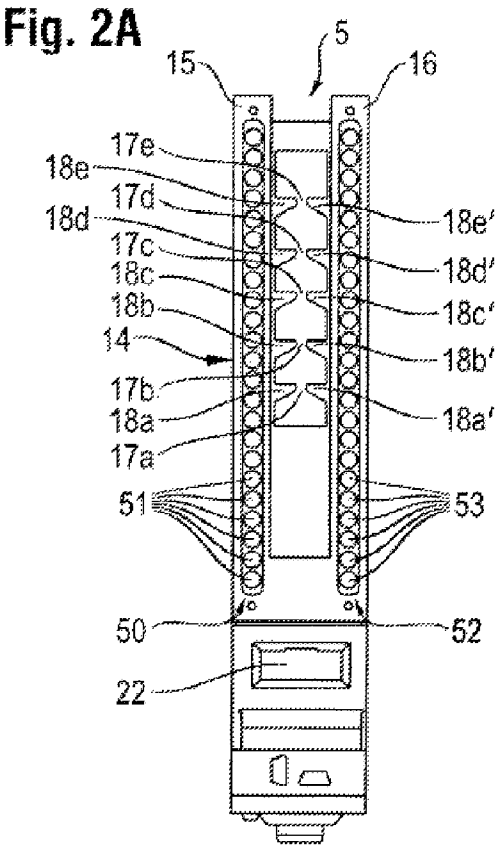
Fig. 2A

Weapon far too low

Weapon too low

Weapon somewhat high

Optimal elevation

FIRE CONTROL SIGHT, HAND-HELD FIREARM AND A METHOD FOR ORIENTING A HAND-HELD FIREARM

CROSS-REFERENCE TO RELATED APPLICATIONS

This application claims priority under 35 U.S.C. §119 to German Application 10 2013 017 997.1, filed Nov. 29, 2013, and German Application 10 2014 001 028.7, filed Jan. 24, 2014, the entire disclosures of which are herein expressly incorporated by reference.

BACKGROUND OF THE INVENTION

Exemplary embodiments of the present invention relate to a fire control sight for a hand-held firearm, a hand-held firearm with such a fire control sight, as well as a method for orienting such a hand-held firearm.

European patent document EP 0 785 406 A2 discloses a grenade launcher that can be mounted on a hand-held firearm is provided with a laser range finder and a digital compass device. The laser range finder is provided with a LED display device by means of which the grenadier can engage the target. With this known device the grenadier is completely dependent on the electronic target engagement device. In the event of a potentially malfunction of the electronic system any redundant target engagement possibility is lacking.

U.S. Pat. No. 6,499,382 B1 discloses an electronic sighting device as target system for a heavy weapon that is fastened so that it can be pivoted and inclined on a stand or another base. This target system is connected to the weapon in such a way that the target system can rotate with the weapon in azimuthal direction and can pivot in the elevation direction. The target system has a camera and a display screen by means of which the grenadier can engage the target. This known device is too large and too heavy for use on a hand-held firearm.

US patent document US 2005/0268521 A1 discloses an electronic sighting device for a firearm equipped with an inclination sensor, an accelerometer and a rate gyro. This sighting device is also large and heavy and less suitable for a hand-held firearm. Moreover, in the event of malfunction of this electronic sighting device no redundancy is available.

Conventional sighting displays frequently use a marking of the holding point inserted into the optical beam path, which has the disadvantage that the aperture angle of the sighting optics must cover the maximum angle of elevation. For distant targets, however, this angle quickly exceeds the conventional sighting aperture angle, since elevations of up to 45° occur. Particularly with these high elevations a distant target (for example 450 meters away) is attacked, a magnifying sight with a small aperture angle would be required for the measurement.

A further generally known solution for the aforementioned target antagonism is the "tilting" of the beam path by means of a motor-powered mirror or a prism inside the sighting optics. Thus there is contradiction between large viewing angles and sufficient magnification. However, such systems have a relatively large inertia of the entire sighting system, which is caused by the motor powered pivoting of the mirror. Moreover, the field of view of the shooter is restricted to the limited aperture angle of the sight.

In the case of all these known electronic sighting devices the shooter must also carry as a fallback solution a conventional control sight, so that in the event of malfunction of the electronic sighting device he can still use the weapon.

Exemplary embodiments of the present invention are directed to a fire control sight, which through intuitive representations enables a quick and exact elevation control for the shooter without the need for a substantially increased weight on a firearm. Moreover, the fire control sight should have redundancy capability if the electronic auxiliary displays fail. Exemplary embodiments of the present invention are also directed to a hand-held firearm with such a fire control sight as well as a method for orienting such a hand-held firearm.

SUMMARY OF THE INVENTION

According to exemplary embodiments of the present invention the fire control sight for a hand-held firearm, in particular for a grenade launcher, is provided with a sight housing, a front sight, a sight guide which has two sight guide side pieces with a plurality of sight crosspieces forming rear sights and is characterized by a range finder, at least one inertial sensor and/or a magnetic field sensor and/or another direction-finding sensor unit, a control computer and a display device for displaying an optimal orientation of the barrel axis of the hand-held firearm determined by the control computer.

This fire control sight according to the invention integrates into a conventional control sight an electro-optical display system that signals the optimal holding point to the shooter and also enables a precise fine orientation by a non-linear optical bar display. The distance data are measured by means of a range finder, for example a laser range finder, and the position the hand-held firearm is determined by means of at least one inertial sensor. Thus the invention consists in the integration into a standard control sight of a display device for display of an optimal orientation of the barrel axis of the hand-held firearm determined by the control computer. The display device is controlled by a control computer, which by means of connected sensors identifies the current location of the hand-held firearm around the pitch angle, the roll angle and the azimuth angle. Furthermore, the distance from the target is determined by a distance measurement with the integrated range finder and the direction to the target is determined by means of the magnetic field sensor or another direction-finding sensor unit (for example by means of gyros). The control computer is provided with or connected to an electronic storage device in which a table of the fire control sight containing projectile parameters is stored. After the measurement of the target position the control computer calculates from these projectile parameters and the recorded measurement data the optimal ballistic trajectory of the projectile to be fired from the hand-held firearm, for example a grenade, and shows the shooter desired elevation on the display arrangement. This inventive combination of a conventional mechanical control sight and an electronic fire control sight may be designated as an "active control sight".

In this case it is particularly advantageous if, for display of the optimal elevation of the barrel axis of the hand-held firearm, the display device has at least one row of electro-optical elevation signal elements, which are preferably formed by LEDs, extending along at least a portion of a sight guide side piece, and if the control computer is designed in order to supply a control device for the electro-optical elevation signal elements with an elevation display signal.

This particularly advantageous fire control sight constitutes an ideal hybridization of the conventional control sight with the electronic display device mounted thereon. In this way the shooter is offered a sighting device that enables the shooter, on the basis of the electronic display device, to quickly and precisely carry out a target engagement of the weapon but which also on the other hand enables, in the event of failure of the electronic display device or other electronic elements, conventional sighting of a target by means of the mechanical control sight, without having to carry an additional control sight and mount it on the hand-held firearm in the event of failure of the electronic system.

The electro-optical elevation signal elements can preferably each assume different, preferably at least two, display states. If the signal elements are for example formed by LEDs, then they can assume the display states OFF, ON and also when switched on also take on different colors. If the display elements for example are not constructed as separate LEDs but are formed by a display screen, then as an alternative to different colors each display element can also have different shapes.

Furthermore, it is advantageous if the display device for displaying the optimal azimuth orientation of the barrel axis of the hand-held firearm has at least one electro-optical azimuth signal element preferably disposed in the region of the front sight. This additional measure makes it possible not only to optimally adjust the angle of elevation but also to provide the shooter with assistance in the horizontal pivoting of the weapon. In this case it is advantageous if the at least one electro-optical azimuth signal element can assume different, preferably at least two, display states. Here too the same display states are provided as in the elevation display.

It is particularly advantageous if the fire control sight additionally has an air temperature sensor, an air pressure sensor, and/or a humidity sensor. Thus, the calculations of the optimal trajectory of the projectile and thus the calculation of the optimal elevation can be carried out even more precisely.

Moreover it is advantageous if a distance display for displaying the distance measured by the range finder is provided so as to be visible to the shooter.

Exemplary embodiments of the invention are also directed to a hand-held firearm provided with a fire control sight according to the invention. This fire control sight can be mounted for example by means of a Picatinny rail on the hand-held firearm, for example on the grenade launcher. Such a Picatinny rail is a standard toothed rail for quick fitting of accessories to hand-held firearms according to the international standard MIL STD 1913.

Exemplary embodiments of the invention are also directed to a method for orienting a hand-held firearm according to the invention with a target, comprising the steps of a) directly sighting the target by means of the fire control sight;
b) determining the distance from the target by means of the range finder;
c) calculating the trajectory and of the angle of elevation by means of the control computer;
d) displaying the calculated angle of elevation and the deviation of the current angle of elevation from the calculated angle of elevation by means of the display device.

In this method, by means of the display device provided, for example on the sight guide side piece, the calculated angle of elevation and the deviation of the current angle of elevation from the calculated angle of elevation are displayed to the shooter who sights the target through rear sights provided on the sight guide side piece via the front sight, so that in the conventional optical sighting of the target the shooter obtains additional information via the display device by means of which the shooter can orient the hand-held firearm quickly and precisely so that the projectile on its ballistic trajectory reliably strikes the target.

An advantageous modification of this method is characterized in that the display of the deviation of the current angle of elevation from the calculated angle of elevation takes place in step d) by means of at least one row of electro-optical elevation signal elements, preferably LEDs, extending along at least one portion of a sight guide side piece, in such a way that the calculated angle of elevation is displayed by a first elevation signal element in a first color and/or symbol representation at the height of the rear sight with which the target must be sighted by means of the front sight, that one or more of the lower elevation signal elements disposed below the first elevation signal elements are displayed in a second color and/or symbol representation, when the current angle of elevation is smaller than the calculated angle of elevation, that one or more of the upper elevation signal elements disposed above the first elevation signal elements are displayed in the second color and/or symbol representation, when the current angle of elevation is greater than the calculated angle of elevation, and that the first elevation signal element changes its color and/or symbol representation when the current angle of elevation is equal to the calculated angle of elevation. The expression "symbol representation" should be understood to mean, for example, a shape or a brightness state of a signal element. Thus, a change of the symbol representation may, for example, be a change of shape of the display (for example alternation between circle and triangle) or a change of brightness of the display (for example a permanent display or flashing at different frequencies).

With this configuration of the method according to the invention a simple, quick and secure orientation of the barrel axis of the hand-held firearm is achieved. The method sequence is configured so that a shooter without much training can operate the weapon intuitively and the correct operation of the fire control sight according to the invention can be virtually imposed upon the shooter by the special configuration of the so-called active control sight with the elevation signal elements.

Preferably in step c) a calculation of the azimuth angle with respect to the target additionally takes place by means of the control computer and in step d) the deviation of the current azimuth angle from the calculated azimuth angle is additionally displayed by means of the display device. This advantageous functionality, which is based on the measurements of the at least one inertial sensor and/or of the at least one magnetic field sensor ensures that the shooter when sighting the target not only obtains assistance for the elevation orientation of the weapon, but also for the azimuth orientation of the weapon and thus a secure target engagement is also achieved in the horizontal direction.

It is particularly advantageous if the display of the deviation of the current angle of elevation from the calculated angle of elevation takes place in step d) by means of at least one row of electro-optical elevation signal elements, preferably LEDs, extending along at least one portion of a sight guide side piece, in such a way that the calculated angle of elevation is displayed by a first elevation signal element in a first color and/or symbol representation at the height of the rear sight with which the target must be sighted by means of the front sight, that one or more of the lower elevation signal elements disposed below the first elevation signal elements are displayed in a second color and/or symbol representation, when the current angle of elevation is smaller than the calculated angle of elevation, that one or more of the upper elevation signal elements disposed above the first elevation signal elements are displayed in the second color and/or symbol representation, when the current angle of elevation is greater than the calculated angle of elevation, and that the first elevation signal element changes its color and/or symbol representation when the current angle of elevation is equal to the calculated angle of elevation.

The shooter is guided intuitively to the correct azimuth orientation of the weapon by these method steps. In a combination of this guided azimuth orientation with the guided elevation orientation a fast and exact target engagement can be implemented even by shooters without much training.

A combined fire control sight that can be used both in a conventional manner as an optical control sight and also in an electro-optically supported manner is created by the combination according to the invention of a conventional control sight with a display device having, for example, LEDs disposed, for example, in the form of a respective line of lights on the left and right on the side pieces of the sight guide. For example, in the line of lights of the display arrangement LEDs are used with two different color elements, by which three colors (color 1, color 2 and the mixed color 1+2) can be represented. For the sake of simplicity the colors red, green and yellow are proposed here, but also any other colors and color combinations are possible. This simple color coding which is informative per se contributes to the functioning of the fire control sight being self-explanatory and the shooter can almost intuitively carry out the orientation steps of the method according to the invention correctly.

Preferred embodiments of the invention with additional configuration details and further advantages are described and explained in greater detail below with reference to the appended drawings.

BRIEF DESCRIPTION OF THE DRAWING FIGURES

In the drawings:

FIG. 2 shows a partially schematic representation of a fire control sight according to the invention in a side view in a position in which it is folded up ready for use;

FIG. 2A shows a rear view of the fire control sight according to the arrow IIA in FIG. 2;

FIG. 2B shows a rear view of the front sight support according to the arrow IIA in FIG. 2;

FIGS. 10A to 10D show different elevation displays on the fire control sight according to the invention at different elevation orientations of the longitudinal axis the hand-held firearm and FIGS. 11A to 11E show different displays on the fire control sight at different azimuth orientations of the hand-held firearm with the control sight according to the invention.

DETAILED DESCRIPTION

Figure 1:
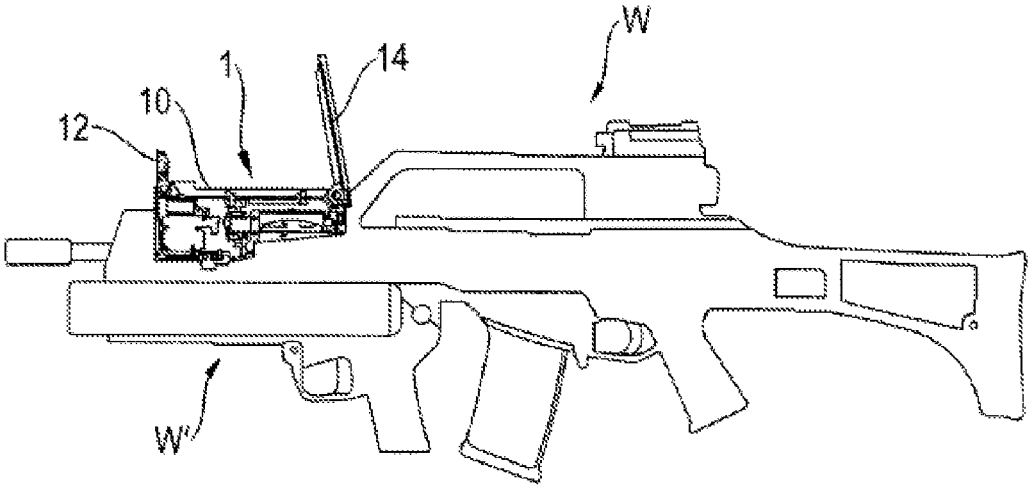
FIG. 1 shows a hand-held firearm equipped with a fire control sight according to the invention.

FIG. 1 shows a fire control sight 1 according to the invention mounted on a hand-held firearm W formed by an assault weapon. A grenade launcher W', for use of which the fire control sight 1 is provided, is likewise mounted on the hand-held firearm W.

The fire control sight 1 has a sight housing 10, a front sight 12, which can be folded out upwards, and a sight guide 14, which can be folded out upwards.

FIG. 2 shows the fire control sight 1 in a partially sectional side view. The functional components provided in the sight housing are shown schematically here. The fire control sight 1 is equipped with a range finder 2, which has a laser range finder 20. Furthermore at least one inertial sensor 3 and at least one magnetic field sensor 6, or a different direction-finding device (for example by means of gyros), are provided. Finally, an air temperature sensor 70, an air pressure sensor 71 and a humidity sensor 72 are also provided. The sensors 3, 6, 70, 71, 72 are connected to a control computer 4, which is likewise provided in the sight housing 10. The range finder 2 is also connected to the control computer 4. A storage battery 40 supplies electrical power to the control computer 4 as well as the sensors and the range finder as well as the display device 5 described below.

The display device 5, which is likewise connected to the control computer 4, comprises a plurality of electro-optical signal elements, which can each be supplied by the control computer 4 with an electrical signal in order to light up in one or different colors.

The sight guide 14 shown in FIG. 2A in a view visible to the shooter is constructed in a conventional manner and has a left sight guide side piece 15, a right sight guide side piece 16 as well as a plurality of sight crosspieces 18*a*, 18*a*', 18*b*, 18*b*', 18*c*, 18*c*', 18*d*, 18*d*', 18*e*, 18*e*', of which in each case a left and a right sight crosspiece determine between them a gap which forms a respective rear sight 17*a*, 17*b*, 17*c*, 17*d*, 17*e*. This construction corresponds substantially to a conventional mechanical sight guide.

In the sight guide 14 according to the invention on each of the two sight guide side pieces 15, 16 a row from electro-optical elevation signal elements 51, 53 are provided, each of which is formed by a row of light-emitting diodes (LEDs). As is described below, these LEDs are controlled by the control computer 4 so that they can be switched off or switched on, wherein at least some of the LEDs can light up in different colors in the switched-on state.

For this purpose the control computer 4 supplies a control device (not shown) for the electro-optical elevation signal elements 51, 53 with an elevation display signal.

Furthermore it can be seen in the view of FIG. 2A that the rear face of the sight housing 10 is provided with an electro-optical display device 22 for displaying the distance measured by the range finder 2.

FIG. 2B shows the view visible to the shooter of the front sight 12, which is provided on a front sight support 11, which can be folded out. Below this front sight 12 an electro-optical azimuth signal element 54 is provided, which likewise belongs to the display device 5 and is formed by a LED. A left azimuth correction signal element 54' and a right azimuth correction signal element 54", which are likewise formed by a LED and belong to the display device 5, are provided to the left and right of the azimuth signal element 54. As shown in FIG. 2B, the two azimuth correction signal elements 54', 54" can be formed by signal elements mounted separately on the front sight support 11. However, the task of these two azimuth correction signal elements may also be taken on by corresponding signal elements on the left or right sight guide side piece 15, 16 lying in the sight line plane to the left and right of the azimuth signal element 54.

Figure 3:
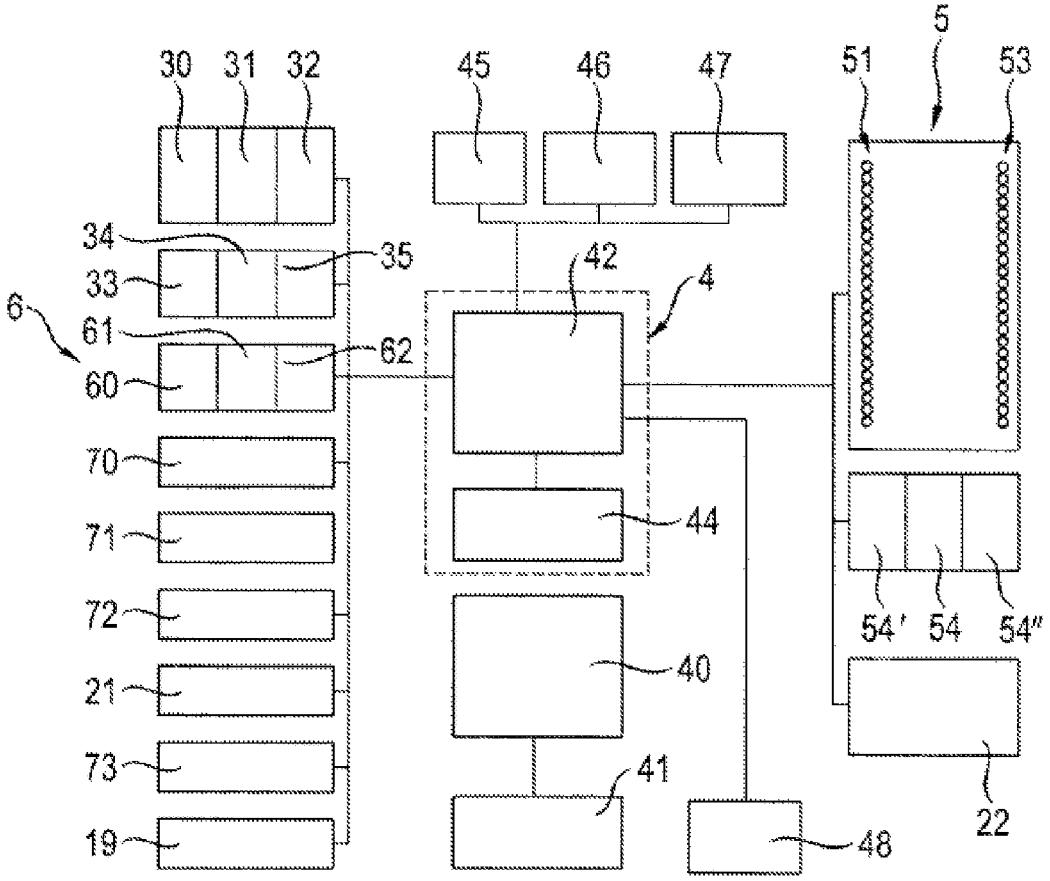
FIG. 3 shows a block wiring diagram of the components of the components of the fire control sight according to the invention.

FIG. 3 shows a block wiring diagram of the components of the fire control sight according to the invention. The control computer 4 comprises a computer unit 42 with a volatile memory disposed therein, as well as a flash memory 44 connected to the computer unit 42. The current supply unit 40 is connected to a battery pack 41 and has a voltage controller with power saving function and automatic switching off of the connected equipment. A plurality of sensors, specifically three acceleration sensors 30, 31, 32, three rotational rate sensors 33, 34, 35, and three magnetic field sensors 60, 61, 62, which together form a magnetic field sensor 6, the air temperature sensor 70, the air pressure sensor 71 and the humidity sensor 72, a laser distance sensor 21 provided in the laser range finder 20 of the range finder 2, and a brightness sensor 73 are connected to the control computer 4. Furthermore, the control computer 4 is connected to a pilot laser 19, which is usually provided on the fire control sight and is constructed in order to emit a laser beam at a minimum distinction and (in the correctly adjusted state of the fire control sight 1) parallel to the beam direction of the laser of the laser range finder 20 and also parallel to the barrel axis X. The pilot laser 19 and the laser range finder 20 are harmonized by the manufacturer with respect to their beam paths.

Furthermore the control computer 4 is connected to input and output devices. Thus, for example, an on/off switch 45, a button 46 for starting the distance measurement, a multifunction control switch 47 as well as a data transmission interface 48 are provided and are connected to the control computer 4.

Finally, the control computer 4 is also connected to the display device 5 which, as already described, has the two series of electro-optical elevation signal elements 51, 53 on the respective sight guide side piece 15, 16, the electro-optical signal element on the front sight support 11 (azimuth signal element 54 and azimuth correction signal element 54', 54") as well as the display arrangement 22 as additional display.

Figure 4:
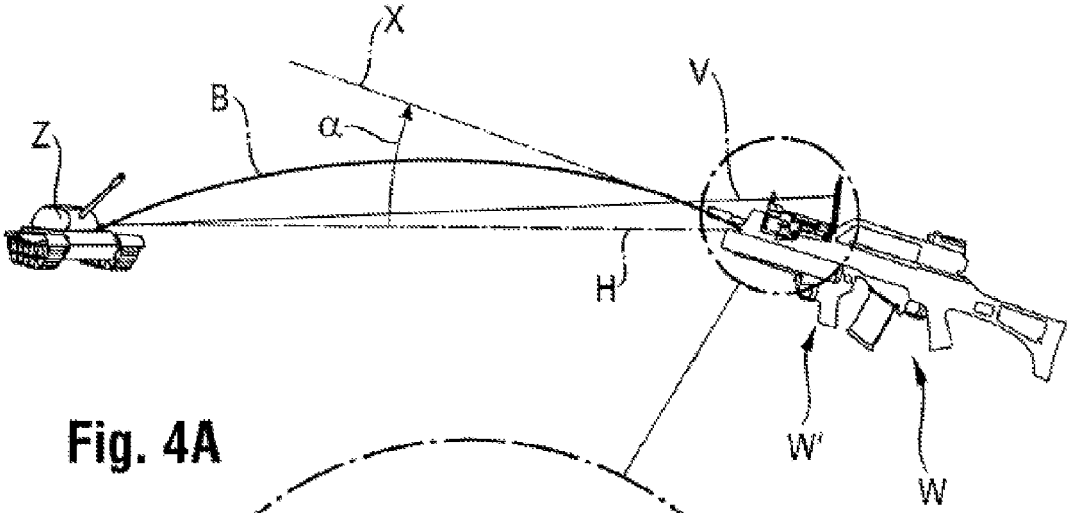
FIG. 4 shows a schematic representation of the orientation of a weapon provided with a fire control sight for achieving a ballistic projectile trajectory.
Figure 4A:
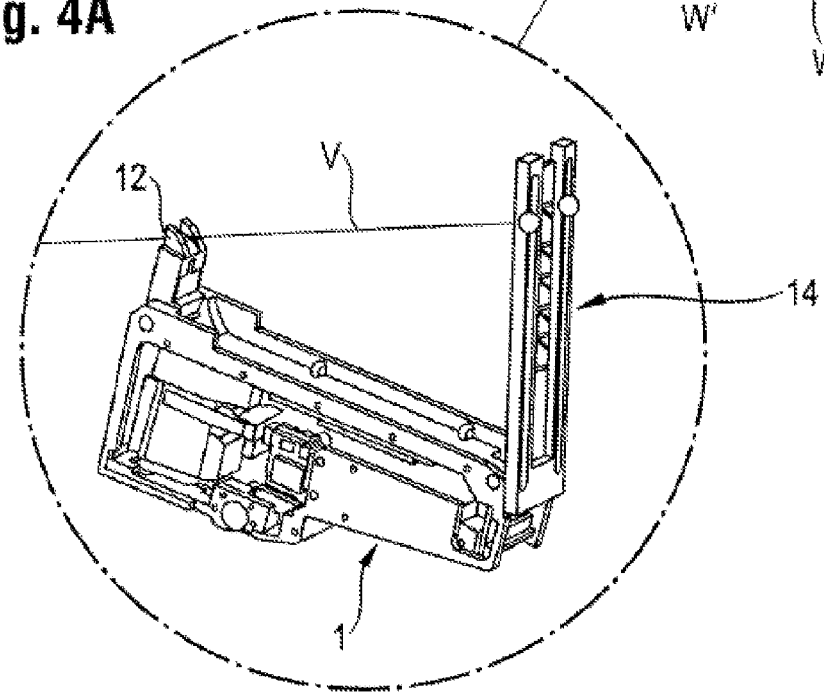
FIG. 4A shows the detail IVA from FIG. 4 with the fire control sight shown there and the sight line.

FIG. 4 and the enlarged detail in FIG. 4A show schematically the orientation of the hand-held firearm W illustrated in FIG. 1 with the barrel axis X inclined at an angle of elevation $\alpha$ to the horizontal H in such a way that the projectile fired from the grenade launcher W' on the hand-held firearm strikes the target Z following the ballistic trajectory B. In this case the sight V extends from the target Z via the front sight 12 for uppermost rear sight 17*e* of the plurality of rear sights disposed one above the other that are provided the sight guide 14.

Figure 5:
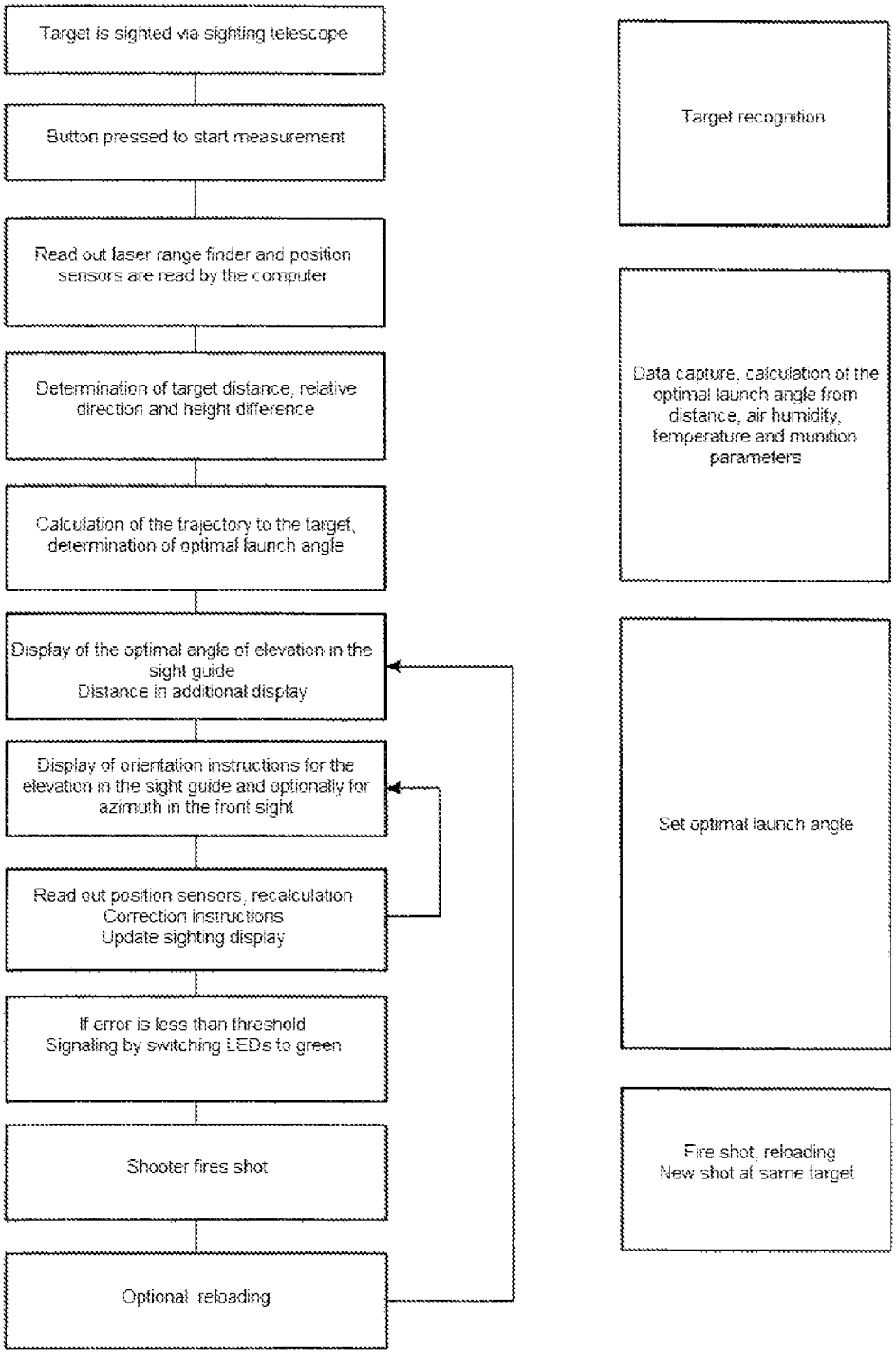
FIG. 5 shows a flow diagram of a method according to the invention for orienting a hand-held firearm with the fire control sight according to the invention.

FIG. 5 shows in a flow diagram the sequence of target recognition, weapon orientation and attacking the target Z. In the left vertical block of FIG. 5 the individual method steps proceeding are listed and in the right vertical block of FIG. 5 are higher level step group designations are assigned to the individual method steps. The method according to the invention for orienting a hand-held firearm with a target comprises the top three method step groups.

The sequence of the use of the fire control sight with active optoelectronic control sight, which is illustrated in FIG. 5, is divided into four phases after switching on:

- target recognition through the weapon sight (by the shooter)
- internal data processing and trajectory calculation (automatic)
- orienting the weapon with the optimal orientation angle in elevation and azimuth (by the shooter based upon the display on the control sight and on the front sight support)
- firing of the shot and optionally reloading for a further shot at the same target.

Figure 6:
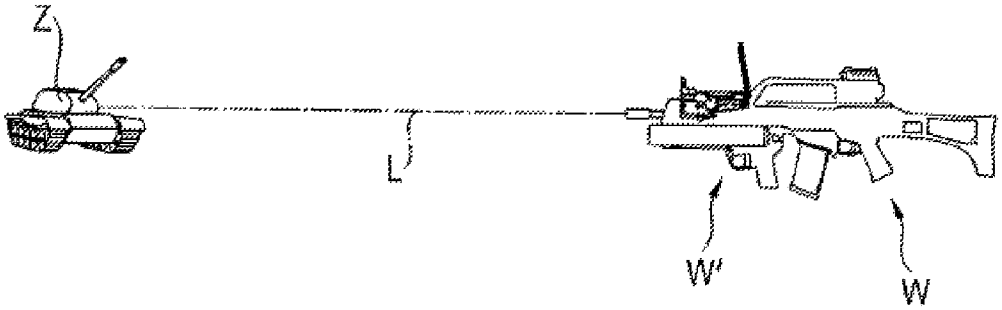
FIG. 6 shows a schematic representation of the orientation of the hand-held firearm provided with the fire control sight for range finding.

FIG. 6 shows the orientation of the weapon W in the step of target measurement, that is to say in the step in which the weapon W is aimed directly at the target Z straightened and in which the laser beam L of the laser range finder 20 operating in a poorly detectable infrared beam range is pointed at the target.

For adjustment of the laser range finder 20 on the weapon, that is to say for harmonization of the weapon sight optics with the laser optics, first of all the pilot laser 19 operating in the visible light spectrum of the inside is switched on, aimed at an object 20 meters to 30 meter away and the installation position of the laser range finder 20 is adjusted by for example two adjusting screws so that the spot of the pilot laser 19 is sighted centrally through the weapon sight. This adjustment step takes place at least immediately after the first mounting of the fire control sight on the weapon, but if required can also be carried out again before each use of the weapon.

For target recognition the shooter uses the sight of the weapon that is familiar to the shooter. The shooter orients the weapon conventionally with the target and presses the button 46 for target recognition through the fire control sight. This button 46 is usually connected to a cable on the fire control sight and is fastened to the weapon at a position suitable for the shooter.

The direct distance from the target Z is merely determined by the laser range finder 20. The distance is displayed digitally in the display of the display device 22 designated in FIG. 5 as an additional display. The inertial sensors (acceleration sensors 30, 31, 32 and rotational rate sensors 33, 34, 35) as well as the magnetic field sensors 60, 61, 62 measure the orientation the weapon W with respect to the target. Potential differences in height between the location of the shooter and the target Z are also detected. Simultaneously the current values for temperature, air pressure, and humidity are read out from the sensors 70, 71, 72. The optimal shot angle (angle of elevation) is calculated by the computer unit 42 of the control computer 4 from these variables, the stored projectile parameters which are read out of the flash memory 44. The azimuth is primarily taken from the measurement.

Figure 7:
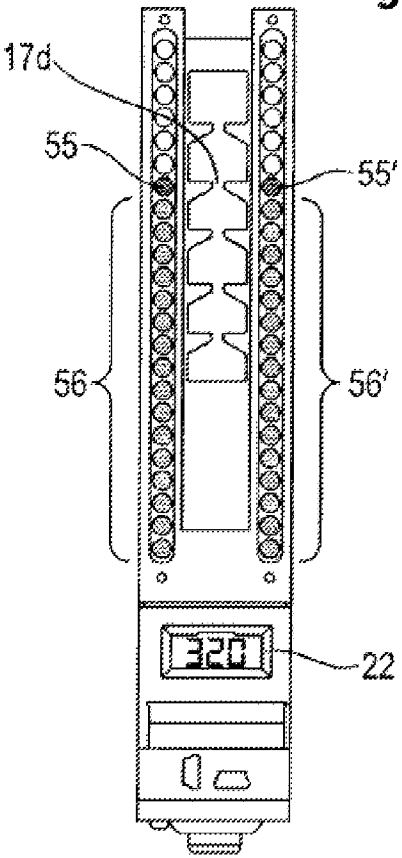
FIG. 7 shows the display on the fire control sight during the orientation of the weapon according to FIG. 6.

FIG. 7 shows the elevation display of the electro-optical elevation signal element on the control sight when directly sighting the target according to FIG. 6, after the distance from the target has been measured and the control computer 4 has calculated the necessary angle of elevation. The left and the right elevation signal element 55, 55', which both lie at the height of the rear sight 17*d* through which the sight line V runs at the correct elevation orientation of the weapon W, light up red since the weapon W is not yet correctly oriented. The elevation signal elements 56, 56' below these two light up yellow and the elevation signal elements disposed above them are switched off. This display, which is also shown in FIG. 10B, indicates to the shooter that he is holding the weapon too low.

Figure 8:
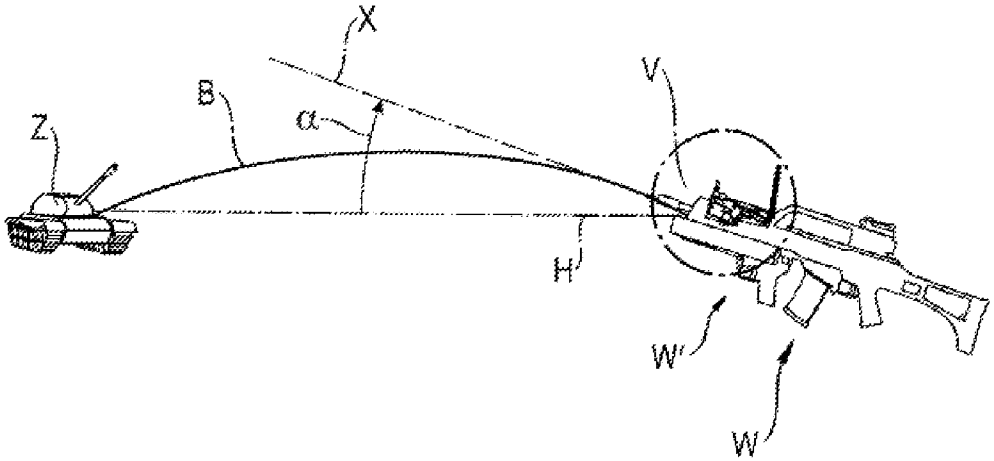
FIG. 8 shows the orientation of the weapon provided with the fire control sight at the optimal elevation of the barrel axis of the hand-held firearm for reaching the target.

In FIG. 8 the orientation of the weapon W at the correct angle of elevation $\alpha$ is shown schematically. The projectile fired from the grenade launcher W' of the weapon W at this angle of elevation α fired follows the ballistic trajectory B in target Z.

Figure 9:
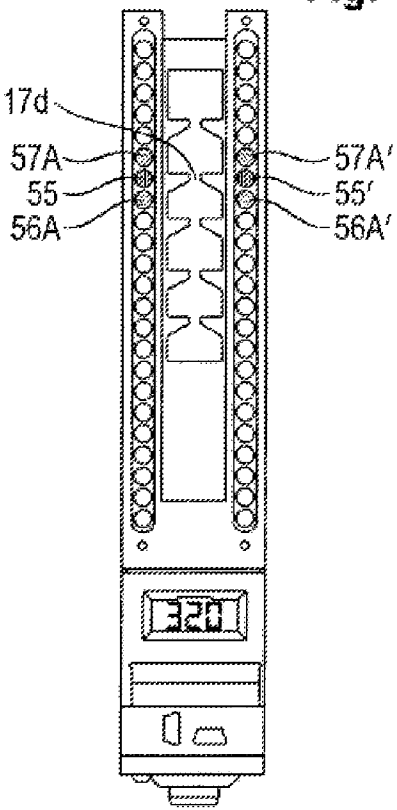
FIG. 9 shows the display on the fire control sight during the orientation of the weapon according to FIG. 8.

FIG. 9 shows the image of the display device 5 in the situation illustrated in FIG. 8 of the correct elevation orientation of the weapon W, wherein now the elevation signal elements 55 and 55' no longer light up red, but green. Merely in each case one left and one right electro-optical elevation signal element 56A, 56A' below the green elevation signal elements 55, 55' which light up green and a left and a right elevation signal element 57A, 57A' disposed above them lights up yellow. This image, which is also reproduced in FIG. 10D, indicates to the shooter that he has oriented the weapon W in the optimal elevation.

Figure 10A:
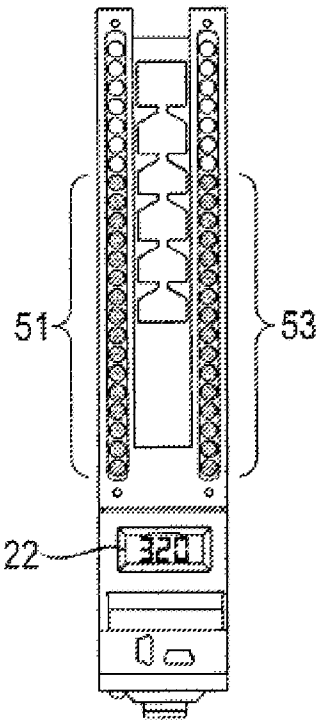
Figure 10B:
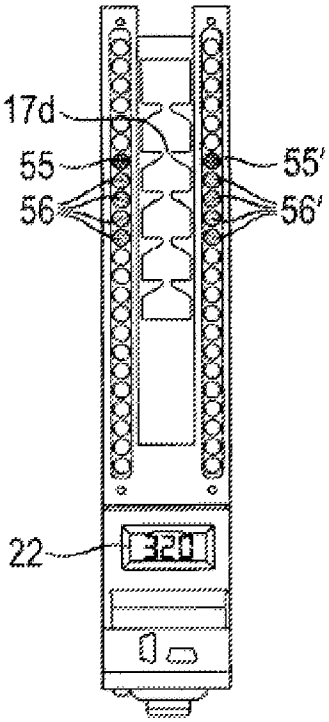

FIGS. 10A to 10D show different signal representations which the display device 5 displays to the shooter at a different elevation orientation of the weapon W. Due to this light bar display the shooter does not have to read off the desired superelevation position from the crosspieces of the sight guide, but it is signaled to him by the light bar display. In the case of a weapon which is oriented too low the image shown in FIG. 10A is displayed to the shooter, wherein approximately the lower two thirds of the respective elevation signal elements 51, 53 provided on the sight guide crosspieces light up yellow, whereas approximately the upper third do not light up.

As the shooter brings the elevation of the weapon W close to the correctly calculated angle of elevation α, then he sees the image shown in FIG. 10B. The desired superelevation position of the weapon W, that is to say the desired angle of elevation, is signaled to him by a right and left elevation signal element 55, 55' which for example lights up red at the desired height. A light bar shown in another color, for example in yellow, has a length proportional to the deviation from the ideal angle. The function by which the deviation angle in the elevation is converted into the length of the light bar, that is to say into the number of elevation signal elements lighting up in this different color (yellow) is non-linear and straddles the region around the optimal value in order to ensure the best possible probability of a hit.

In the image of FIG. 10B the optimal shot angle is signaled to the shooter by the elevation signal elements 55, 55' lighting up red at the height of each rear sight 17*d*, with which he must bring the front sight 12 and the target Z into line for an optimal shot. Furthermore, the distance from the target is displayed to the shooter in the display of the display device 22. As soon as the shooter orients the weapon, the display of the display device 22 changes to the distance from the target at which a shot fired at this angle of elevation would strike.

Whereas FIG. 10A shows the sighting display that the shooter sees when he has not yet set the weapon at an angle of elevation in the horizontal measuring orientation and he is notified by the yellow light bar display that the weapon is held too low, FIG. 10B shows the display when the shooter is still holding the weapon a little too low. The length of the particular yellow light bar is non-linearly proportional to the vertical misalignment and is spread in the vicinity of the optimal angle of elevation so that the display of the transition from the view shown in FIG. 10A to the view shown in FIG. 10B is more sensitive.

Figure 10C:
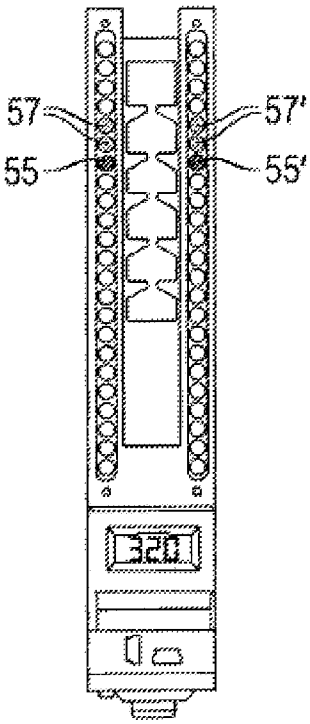

Like the view in FIG. 10B, in FIG. 10C the display of the elevation signal elements is shown that is offered to the shooter when he holds the weapon oriented too high. In this case, above the elevation signal elements 55, 55' displaying the optimal angle of elevation indicating in each case a short yellow bar is formed by the elevation signal elements 57, 57' located thereabove.

Figure 10D:
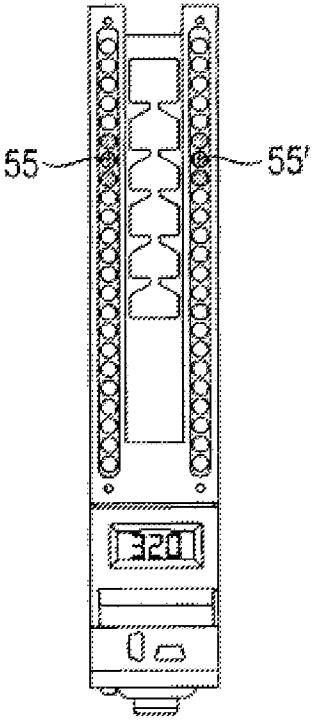

FIG. 10D shows the image offered to the shooter when the weapon W is optimally oriented. In this case the elevation signal elements 55, 55' indicating the optimal angle of elevation switch from the first color (for example red) to a second color (for example green) and in each case an elevation signal element above and below lights up yellow, which serves better visualization of the correct angle of elevation, but does not necessarily have to be provided.

Figure 11A:
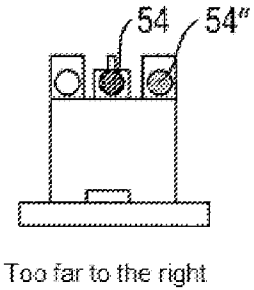
Figure 11B:
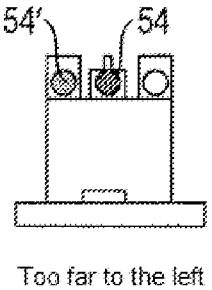
Figure 11C:
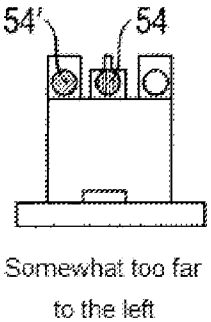

In a similar manner the correct azimuth orientation of the weapon is displayed to the shooter, as illustrated in FIG. 11A to 11E. Since the shooter usually sights the target directly through the rear sight via the front sight 12, this azimuth assistance is not absolutely necessary. The visualization illustrated in FIGS. 11A to 11E proceeds in a similar manner to the elevation orientation of the weapon illustrated in FIGS. 10A to 10D. The central azimuth signal element 54 lights up red, so long as no optimal horizontal orientation takes place. The azimuth correction signal element 54" located alongside to the right lights up yellow when the weapon is too far to the right (FIG. 11A). The azimuth correction signal element 54' lights up yellow when the weapon is oriented too far to the left (FIG. 11B). In the event of only slight lateral misalignment of the weapon, in addition to the in yellow light up corresponding correction signal element (54' or 54") which lights up yellow the middle azimuth signal element is already lit up green, as is shown in FIG. 11C for a weapon oriented somewhat too far to the left.

If the horizontal orientation is correct, then the middle azimuth signal element 54 lights up green and the two lateral azimuth correction signal elements 54', 54" light up yellow (FIG. 11D).

If both the elevation and also the azimuth is correct, all three signal elements, that is to say the azimuth signal element 54, the left azimuth correction signal element 54' and the right azimuth correction signal element 54" light up green (FIG. 11E).

If the optimal orientation of the weapon W is achieved, the shooter fires the shot. If required, the weapon can be reloaded and the target still stored can be attacked again and if need be the target position can be easily corrected, as taking account of the distance display on the display device 22 he deliberately a predetermined distance further or less far.

The multifunction control switch 47 already mentioned and shown schematically in FIG. 3 can serve for switching different functions, for example:

- a manual distance correction of the target distance displayed on the display of the display device 22, for example for correction for further shots,
- a switchover between different stored parameter sets for different types of munition,
- a switchover of the language and the units used (for example meters or feet),
- an activation of the pilot laser,
- a readjustment of the display brightness,
- a display of maintenance information.

The brightness of the electro-optical signal elements and of the background lighting for the display of the display device 22 is set automatically as a function of the external brightness. For this purpose the signal of the brightness sensor 73 is evaluated. Moreover, for example by means of the multifunction control switch 47, a residual light amplifier mode can be selected, wherein the brightness of the background lighting of the display of the display device 22 and also the brightness of the electro-optical signal elements is minimized to the extent that it is almost invisible to the naked eye but is still discernible by means of the residual light amplifier.

Moreover, the fire control sight 1 according to the invention has a power saving function as well as an automatic switch-off depending upon a predetermined time limit and upon a movement of the fire control sight or the weapon equipped therewith.

New munition parameters can be loaded into the corresponding memory (for example the flash memory 44) of the fire control sight 1 via the data transmission interface 48. Furthermore status information such as error codes can be read out via the data transmission interface 48 and internal configuration data can be modified.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

Reference signs in the claims, the description and the drawings serve merely for better understanding of the invention and are not intended to limit the scope of protection.

LIST OF REFERENCE SIGNS

The reference signs designate:

1 fire control sight
2 range finder
3 inertial sensor
4 control computer
5 display device
6 magnetic field sensor
10 sight housing
11 front sight support
12 front sight
14 sight guide
15 left sight guide side piece
16 right sight guide side piece
17*a*, 17*b*, 17*c*, 17*d*, 17*e* rear sight
18*a*, 18*b*, 18*c*, 18*d*, 18*e* sight crosspieces
18*a*', 18*b*', 18*c*', 18*d*', 18*e*' sight crosspieces
19 pilot laser
20 laser range finder
21 laser distance sensor
22 electro-optical display device
30, 31, 32 acceleration sensors
33, 34, 35 acceleration sensors
40 storage battery
42 computer unit
44 flash memory
45 on/off switch
46 button for starting the distance measurement
47 multifunction control switch
48 data transmission interface
51 electro-optical elevation signal element
53 electro-optical elevation signal element
54 electro-optical azimuth signal element
54', 54" azimuth correction signal element
55, 55' elevation signal element
56, 56', 56A, 56A' elevation signal element
57, 57', 57A, 57A' elevation signal element
60, 61, 62 magnetic field sensors
70 air temperature sensor
71 air pressure sensor
72 humidity sensor
73 brightness sensor
α angle of elevation
B ballistic trajectory
H horizontal
L laser beam
V sight line
W hand-held firearm
W' grenade launcher
X barrel axis
Z target

What is claimed is:

1. A fire control sight for a hand-held firearm, comprising:
a sight housing;
a front sight;
a sight guide having two sight guide side pieces with a plurality of sight crosspieces forming rear sights;
a range finder,
at least one of an inertial sensor and a direction-finding sensor unit;
a control computer; and
display device configured to display an optimal orientation of a barrel axis of the hand-held firearm determined by the control computer.

2. The fire control sight of claim 1, wherein
the display device includes, for display of the optimal elevation of the barrel axis of the hand-held firearm, at least one row of electro-optical elevation signal elements extending along at least a portion of a sight guide side piece,
the control computer is configured to supply an elevation display signal to a control device for the electro-optical elevation signal elements.

3. The fire control sight of claim 2, wherein the electro-optical elevation signal elements are light emitting diodes.

4. The fire control sight of claim 2, wherein the electro-optical elevation signal elements are structurally configured to assume at least two different display states.

5. The fire control sight of claim 1, wherein the display device includes, for displaying the optimal azimuth orientation of the barrel axis of the hand-held firearm, at least one electro-optical azimuth signal element disposed in a region of the front sight.

6. The fire control sight of claim 5, wherein the at least one electro-optical elevation signal element is structurally configured to assume at least two different display states.

7. The fire control sight of claim 1, further comprising:
an air temperature sensor;
an air pressure sensor; or
a humidity sensor.

8. The fire control sight of claim 1, further comprising:
a display device configured to display a distance measured by the range finder.

9. The fire control sight of claim 1, wherein the direction-finding sensor unit comprises one of a magnetic field sensor and a gyro.

10. A hand-held firearm, comprising:
a fire control sight for a hand-held firearm, comprising
a sight housing;
a front sight;
a sight guide having two sight guide side pieces with a plurality of sight crosspieces forming rear sights;
a range finder,
at least one of an inertial sensor and a direction-finding sensor unit;
a control computer; and
display device configured to display an optimal orientation of a barrel axis of the hand-held firearm determined by the control computer.

11. The hand-held firearm of claim 10, wherein the direction-finding sensor unit comprises one of a magnetic field sensor and a gyro.

12. A method for orienting a hand-held firearm with a target, comprising the steps of:

a) directly sighting the target by using a fire control sight;

b) determining, by a range finder, a distance between the hand-held firearm and the target;

c) calculating, by a control computer, a trajectory and angle of elevation;

d) displaying, on a display device of the hand-held firearm, the calculated angle of elevation and deviation of a current angle of elevation from the calculated angle of elevation.

13. The method of claim 12, wherein the display of the deviation of the current angle of elevation from the calculated angle of elevation takes place in step d) by at least one row of electro-optical elevation signal elements extending along at least one portion of a sight guide side piece, in such a way that the calculated angle of elevation is displayed by a first elevation signal element in a first color or symbol representation at the height of a rear sight with which the target must be sighted by a front sight, one or more of the lower elevation signal elements disposed below the first elevation signal elements are displayed in a second color or symbol representation, when the current angle of elevation is smaller than the calculated angle of elevation, one or more of the upper elevation signal elements disposed above the first elevation signal elements are displayed in the second color or symbol representation, when the current angle of elevation is greater than the calculated angle of elevation, the first elevation signal element changes its color or symbol representation when the current angle of elevation is equal to the calculated angle of elevation.

14. The method of claim 12, wherein step c) further comprises calculating, by the control computer, an azimuth angle to the target, and step d) further comprises displaying, on the display device, a deviation of a current azimuth angle from the calculated azimuth angle.

15. The method of claim 14, wherein the display of the deviation of the current azimuth angle from the calculated azimuth angle takes place in step d) by at least one electro-optical azimuth signal element disposed in a region of a front sight, in such a way that the calculated azimuth angle is displayed by a first middle azimuth signal element in a first color or symbol representation, at least one left azimuth signal element disposed on the left side of the first azimuth signal element is displayed in a second color or symbol representation, if the current azimuth angle is directed too far to the left with regard to the calculated azimuth angle, at least one right azimuth signal element disposed on the right side of the first azimuth signal element is displayed in a second color or symbol representation, if the current azimuth angle is directed too far to the right with regard to the calculated azimuth angle, and the first azimuth signal element changes its color or symbol representation if the current azimuth angle is equal to the calculated azimuth angle.

* * * * *